United States Patent [19]

Kochanneck

[11] 4,079,847

[45] Mar. 21, 1978

[54] VEHICLE STORAGE INSTALLATION WITH MEANS TO TRANSPORT VEHICLES

[76] Inventor: Uwe Kochanneck, Neuer Graben 81, 46 Dortmund, Germany

[21] Appl. No.: 674,741

[22] Filed: Apr. 7, 1976

Related U.S. Application Data

[63] Continuation-in-part of Ser. No. 553,733, Apr. 21, 1975, abandoned, and Ser. No. 669,298, Mar. 22, 1976, said Ser. No. 553,733, is a continuation-in-part of Ser. No. 442,715, Mar. 26, 1974, abandoned, said Ser. No. 669,298, is a continuation of said Ser. No. 442,715.

[30] Foreign Application Priority Data

Apr. 12, 1975 Germany ..... 2516038

[51] Int. Cl.[2] ..... E04H 6/06

[52] U.S. Cl. ..... 214/16.1 CA

[58] Field of Search ..... 214/16.1 R, 16.1 C, 214/16.1 CA, 16.1 DC, 16.4 A

[56] References Cited

U.S. PATENT DOCUMENTS

| | | | |
|---|---|---|---|
| 1,594,368 | 8/1926 | Jacobos | 214/16.1 CA |
| 1,903,274 | 3/1933 | Watson | 214/16.1 CA |
| 2,801,011 | 7/1957 | Overlach et al. | 214/16.1 CA |
| 2,899,687 | 8/1959 | Jacobsen | 214/16.1 CA |
| 2,904,200 | 9/1959 | Diehl | 214/16.1 CA |

*Primary Examiner*—Drayton E. Hoffman
*Assistant Examiner*—R. B. Johnson
*Attorney, Agent, or Firm*—Michael J. Striker

[57] ABSTRACT

An apparatus for lifting a motor vehicle has a horizontally displaceable support frame on which is mounted a plurality of horizontal arms pivotal on the frame about respective upright axis and each having one horizontally extending upwardly concave part-cylindrical surface shaped to fit against the respective wheel of a motor vehicle positioned adjacent the frame. A drive motor is provided on the frame for pivoting the arms about their respective axes and thereby bringing the surfaces into and out of engagement with the respective vehicle wheels. A deflectable switching rod is mounted on each arm and operates a switch so that when one or two or more arms are tightly engaged against the respective wheels, the drive is shut off so that the frame may be lifted to carry away the entire motor vehicle. Such an arrangement is useable in an automatic car-parking garage.

10 Claims, 6 Drawing Figures

C
23
24
5
20
21
27
28
26
30
29
31
49
31
45
25
A
W

VEHICLE STORAGE INSTALLATION WITH MEANS TO TRANSPORT VEHICLES

CROSS-REFERENCE TO RELATED APPLICATIONS

This application is a continuation-in-part of U.S. patent applications Ser. No. 553,733 (now abandoned) filed on Apr. 21, 1975 and Ser. No. 669,298 filed on Mar. 22, 1976. Ser. No. 553,733 was a continuation-in-part of U.S. patent application Ser. No. 442,715 (now abandoned) filed on Mar. 26, 1974 and Ser. No. 669,298 was a continuation of Ser. No. 442,715.

BACKGROUND OF THE INVENTION

This application relates to a lifting device for a motor vehicle. More particularly this invention concerns an apparatus for lifting and holding an automotive vehicle in a self-parking garage or the like.

Application Ser. No. 553,733 describes an automatic subterranean parking garage that is located beneath a sidewalk extending along a vehicular road. The inlet and outlet for the garage is on the road pavement itself and normally covered by a horizontal roller door. Beneath this door is provided a lift shaft in which the load platform of a vertical conveyor can be moved between the level of the pavement and a subterranean parking level.

Furthermore in accordance with this present invention the operations of the garage are automatically controlled by inserting a data carrier, such as a punched card or the like, into a control post which transmits parking and retrieving commands to the parking system of the garage.

If a car is to be parked according to my earlier application the requisite data carrier is inserted into the control post and this results in immediate opening of the door, exposing the platform of the vertical conveyor. The car is then driven onto this platform, the operator leaves the vehicle and again inserts the data carrier into the control post. In response to this second insertion, the automatic parking system lowers the platform and vehicle to the parking level while closing the roller door. On reaching the level the vehicle will be engaged by the load-gripping device which moves over the platform and removes the vehicle therefrom to transport it to a free parking space on the level which was preselected by insertion of the data carrier into the control post. When the vehicle is to be retrieved, the above sequence of operations is carried out in reverse, again automatically.

Application Ser. No. 553,733 further describes an embodiment of the garage for accommodating large numbers of vehicles, e.g., to be located beneath a large roadway, beneath a playground or the like. In such a case where a single-row parking level such as is described above will not offer a sufficient number of parking spaces, my garage is of the multi-row construction.

In accordance with this arrangement described in my earlier application the functional principle is, of course the same except that the load-gripping device reaches the different parking rows of the garage by being suspended from travelling ceiling cranes, or by means of inserted transversely travelling ceiling cranes working along and in front of the parking rows to transport the load-gripping devices from one row to the other.

SUMMARY OF THE INVENTION

It is an object of the present invention to provide a car-lifting device useable in the systems described in my above-cited patent applications.

Another object is the provision of such a device which, without using a complicated pallet or cabin structure, can be employed to lift a motor vehicle.

Yet another object is the provision of such an arrangement which can be used to lift cars of different sizes and which is safe and sure in operation.

A further object is the provision of such a lift-lifting device which functions automatically to engage a car standing on the ground and which can thereafter be used to lift the car free from the ground in an automatic parking garage.

These objects are attained according to the present invention in an apparatus having a displaceable support frame on which are provided a plurality, here four, of horizontal arms which are pivotal about respective upright axis and which each have a horizontally extending surface facing generally upwardly and inclined to the vertical and horizontal so as to be engageable with a respective wheel of a motor vehicle at the frame. Drive means is provided on the frame for pivoting each of these arms about its respective axis and thereby bringing the surfaces of the arms into and out of engagement with the respective wheels. A deflectable switching element mounted on each arm above and spaced from the respective surface operates a switch on each arm that is interconnected with the drive means so that the pivoting of the arms is arrested when the switching elements have been deflected by engagement thereagainst of a motor-vehicle wheel.

Thus, with the system according to the present invention each arm is brought into engagement with a respective motor vehicle wheel so that the frame is locked to the car at the wheels of the car. Thereafter the frame can be lifted and the entire car can be transported, resting on its wheels on the arms, to the appropriate storage place.

According to further features of this invention each of the wheel-engaging surfaces is shaped complementarily to the outer surface of the respective wheel. Thus each surface is generally cylindrically concave and a tangent to the curve at the lowermost edge is virtually horizontal. Thus each arm can almost reach under the respective wheel so as securely to engage against the bottom and side thereof and securely support the respective motor vehicle via its road-engaging wheels.

According to other features of this invention the drive means includes a motor for each pair of arms positively linked to these arms so as positively to rotate them always in opposite directions. According to this invention the arms are rotated between a first position pointing toward one another and a second position extending parallel to one another. They are displaced between these positions by the drive means after the frame has been juxtaposed with a car or a car has been moved next to the frame. The switches for the two linked-together arms on each side of the vehicle are connected in series to the respective drive means so that only when both of the switches are actuated does the drive means stop pivoting the two arms. This effects an automatic self-centering of the frame on the vehicle so as securely to engage it and prevent any damage to the vehicle during the lifting and transporting operation.

According to yet another feature of this invention the switch element is a rod extending horizontally above the respective surface of the respective arm and pivoted on the respective arm about a horizontal axle thereon. This rod is urged by means of a torsion spring into a position normally lying above the surface but can be deflected by the respective wheel into a position beyond the surface when engaged by a motor-vehicle wheel.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

DESCRIPTION OF THE PREFERRED EMBODIMENTS

Figure 1:
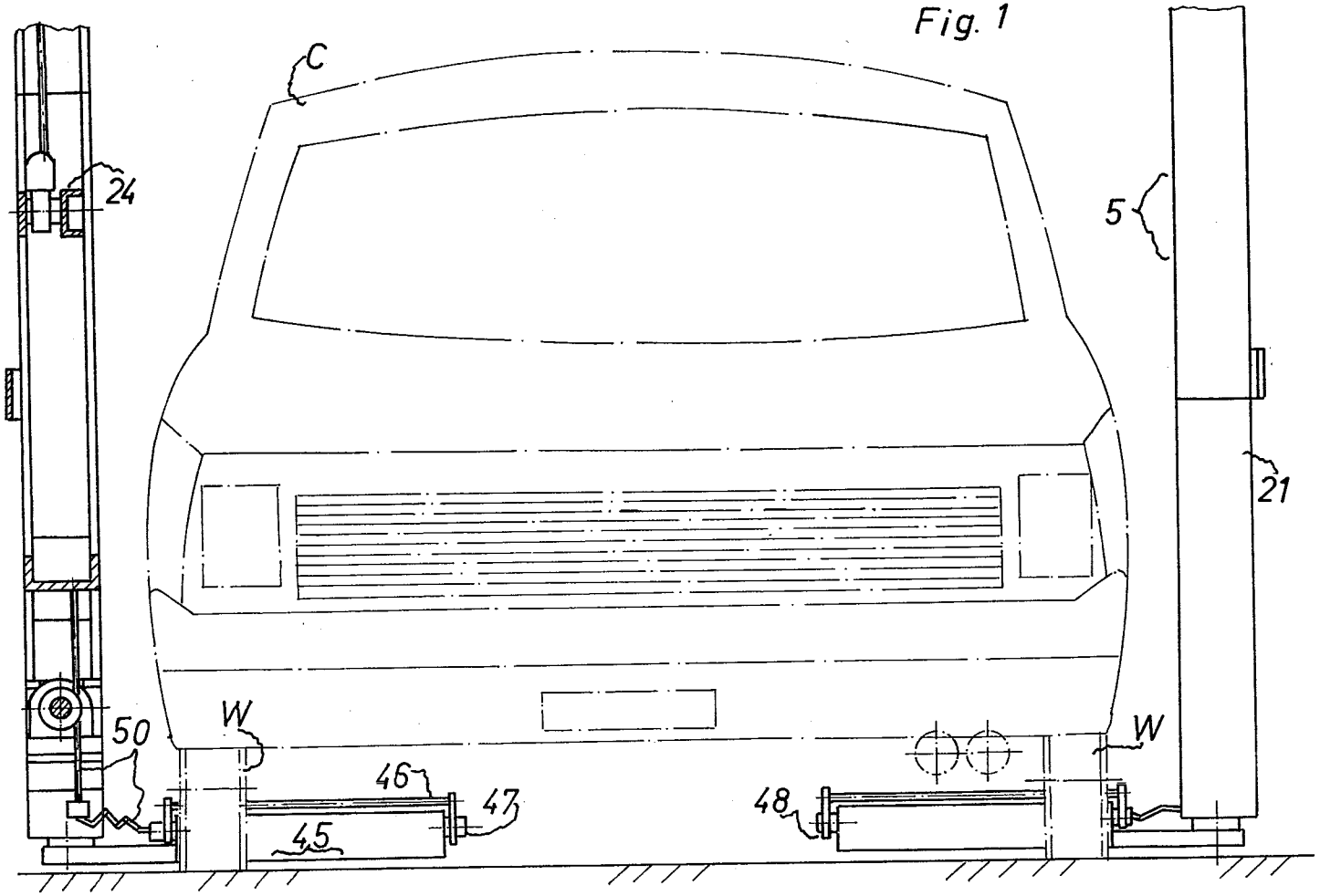
FIG. 1 is an end view partly in section illustrating the lifting apparatus according to this invention.
Figure 2:
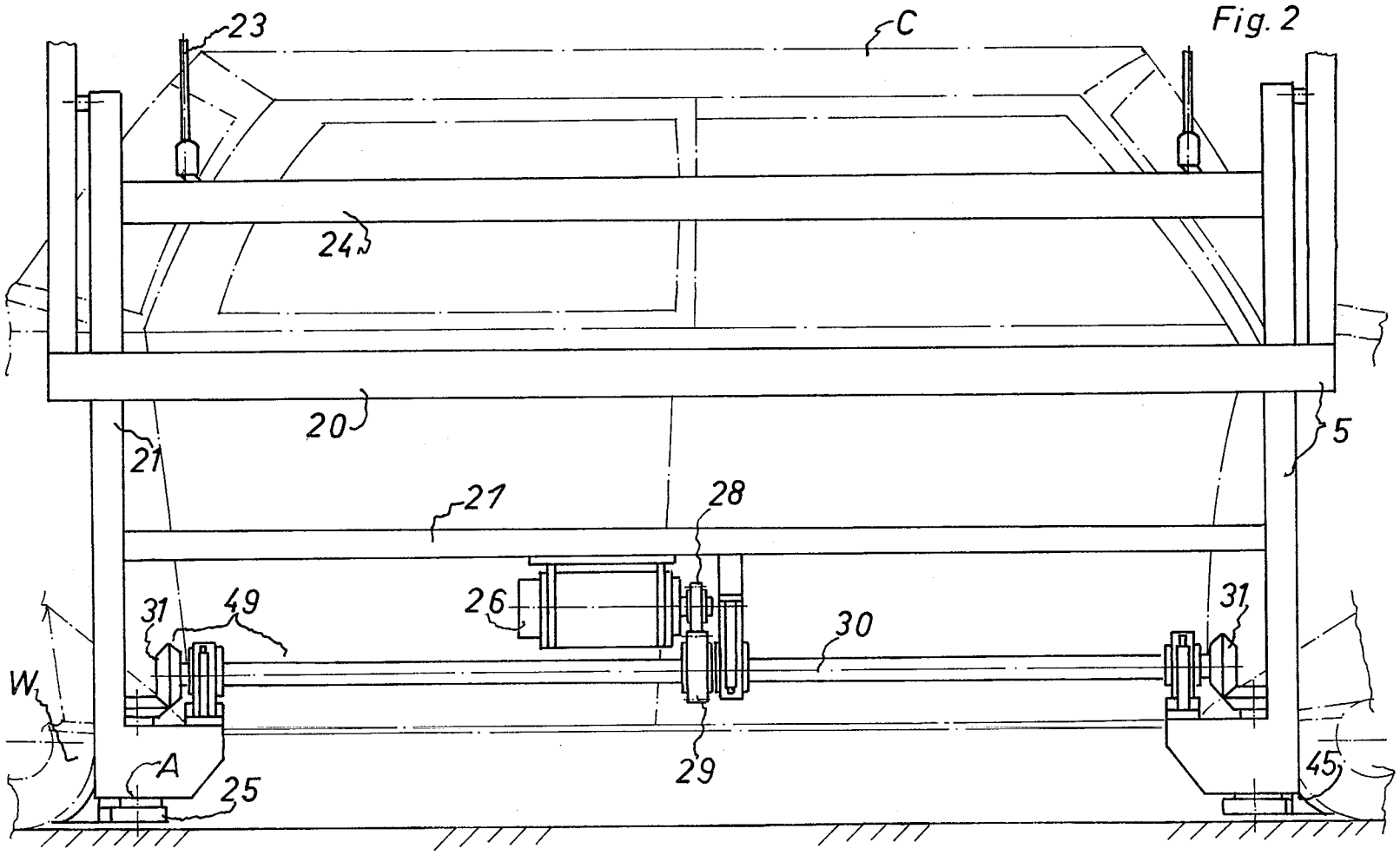
FIG. 2 is a side view of the apparatus shown in FIG. 1.
Figure 7:
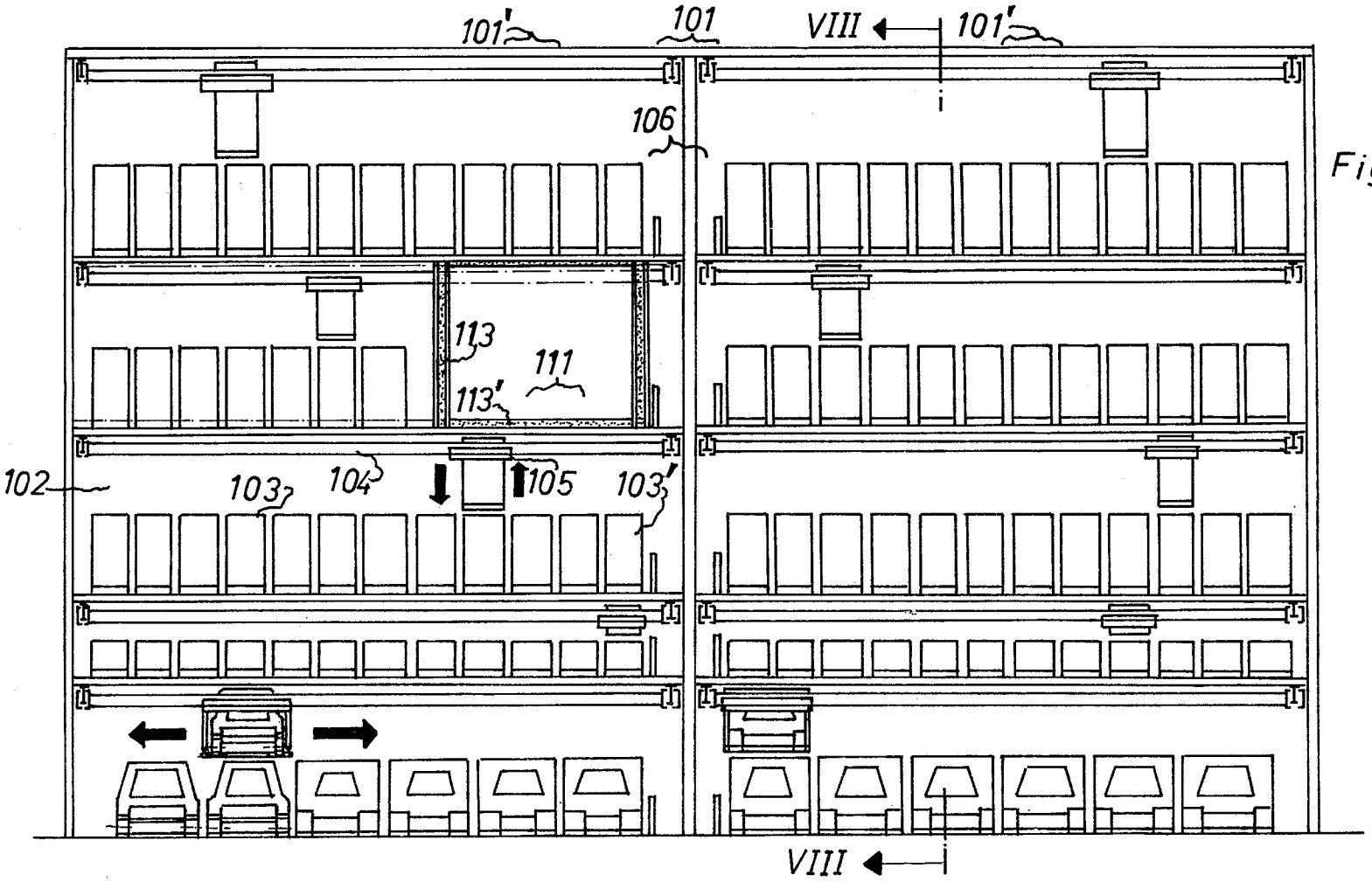
FIG. 7 is a vertical section through a storage installation.
Figure 8:
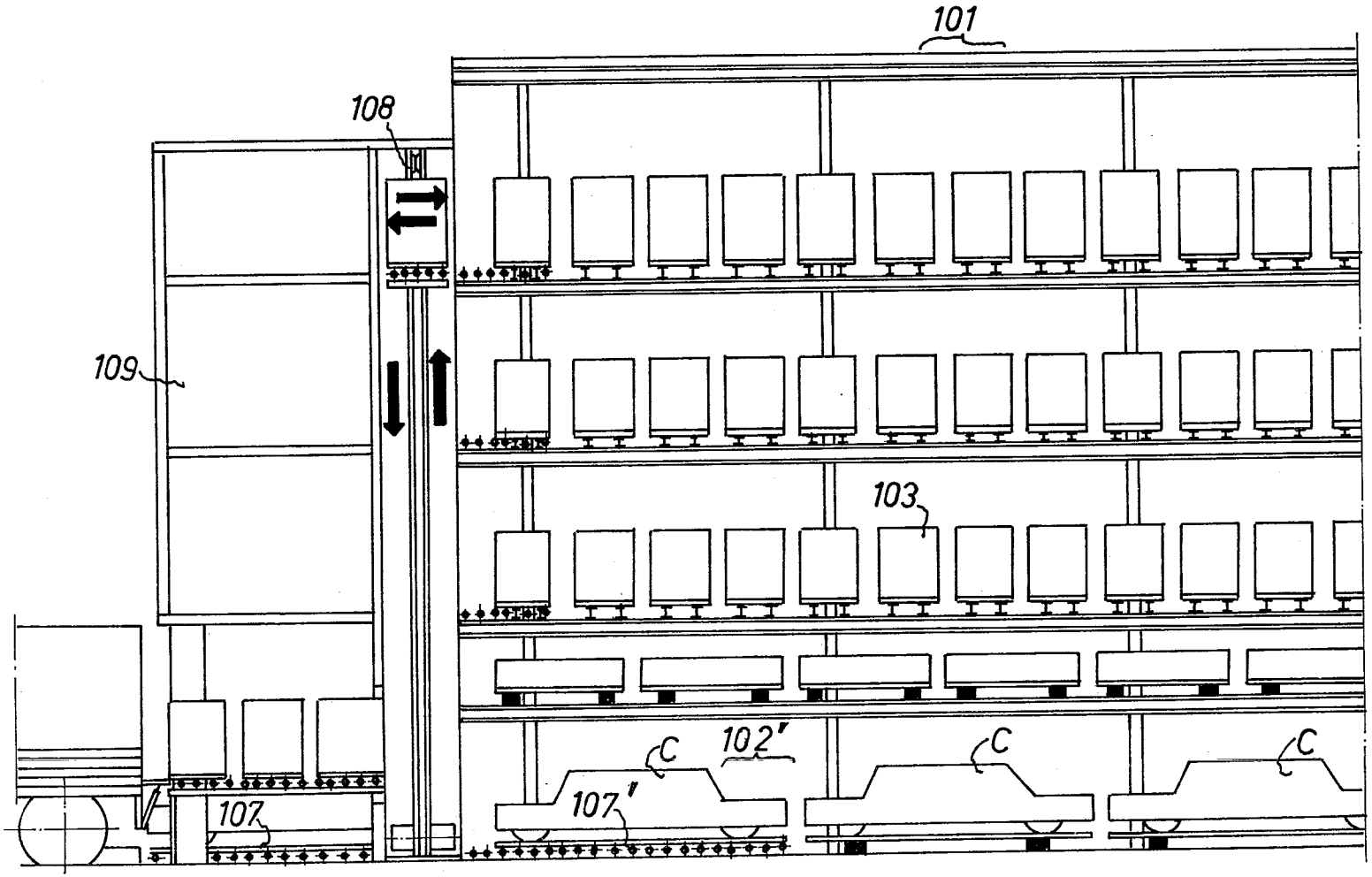
FIG. 8 is a section taken along line VIII—VIII of FIG. 7.

Reference is first made to FIGS. 7 and 8, which are FIGS. 1 and 2 from my copending parent application cited above.

FIG. 7 shows a storage installation 101 composed of two independently constructed storage blocks 101'. Within the respective load planes or floors 102 may move loads 103 held by ceiling travelling rails 104 on which move separate load-gripping appliances 105. Storage blocks 101' are connected by aisles within the planes or floors. The aisles 106 are at the center of the installation 101 and preferably serve for manual handling of ready loads 103'. Above these aisles 106 is provided sufficient space for the rails 104 and the appliances 105.

FIG. 8 shows the front part of the storage installation 101 which receives the main goods entrance zone and exit zone. In the undermost load plane 102' or storage floor in front of the storage blocks 101 there is provided on motor-driven conveyor belts 107 cars C kept ready as loads 103 for incoming storage procedure so that they can be fed to entrance positions 107'. The load-gripping appliances 105 carry out the pickup and parking procedure from the infeed position 107' to any free storage space in the load plane 102'. Cars are recovered in a backward analogous manner. Long materials are stored as loads 103 over the load plane 102'. The infeed procedure and the outfeed procedure for the load plane with long materials is effected only partially in front of the storage installation 101. Motor-driven conveyor belts are not provided at the infeed positions 107' for this load plane. The reception and delivery is effected directly from the infeed and outfeed positions 107' by fork trucks which execute in front of the storage installation 101 at a floor level of the load plane 102' intake and output procedure. The further superposed load planes 102 receive standard pallets as loads 103. Every input and output position 107' is here equipped with one motor-driven conveyor belt. When the loads 103 and the respective load planes 102 at the input and output positions 107' cannot be reached by the input and output fork trucks in front of the storage installation 101 the reception and delivery of loads 103 is effected by vertical conveyor 108 which are likewise equipped with one motor-driven conveyor belt by which they are connected to the infeed positions 107'. The control center of the storage installation 101 is situated in front of the storage installation 101 within the building part 109.

The load lifting appliances 105 each basically comprise, as shown in FIGS. 1 and 2, a frame 5 comprising an upper portion 20 and a lower portion 21. Cables 23 or the like attached to a horizontal beam 24 on each side of the lower member 21 serve for vertically displacing this lower member 21 relative to the upper member 20. The entire frame 5 of each such device can be moved around the automatic parking garage in the manner described in my above-cited patent applications.

Figure 6:
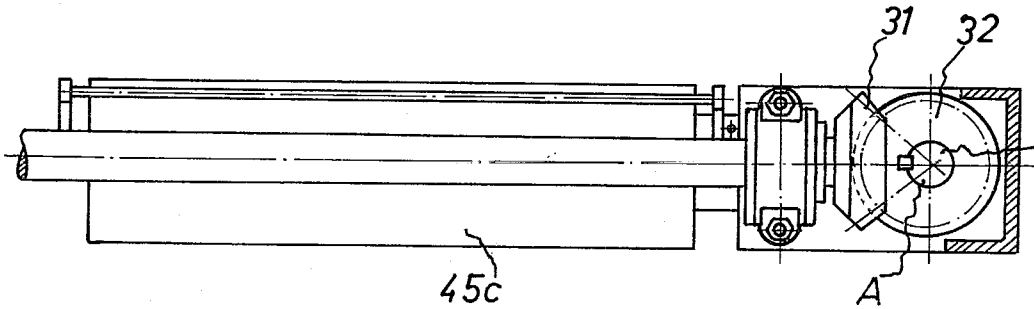
FIG. 6 is a section taken along line VI—VI of FIG. 5.

Each lower frame 21, of which two are provided for each frame 4, carries two arms 25 pivotal about respective vertical axes A. A longitudinally extending beam 27 on each of the frames 21 carries a motor 26 whose output shaft carries a gear 28 meshing with a gear 29 on a single shaft 30 carrying at each end a bevel gear 31 meshing with a respective bevel gear 32 keyed to a shaft 33, as shown in FIG. 6, lying on the respective axis A. The arms 25 extend horizontally, that is perpendicular to the axes A and the gears 31 and 32 form transmissions 49 that operate so that the one arm 25 on each frame 21 will swing in one direction when the motor 26 operates whereas the other arm 25 will always swing in the opposite direction.

Figure 4:
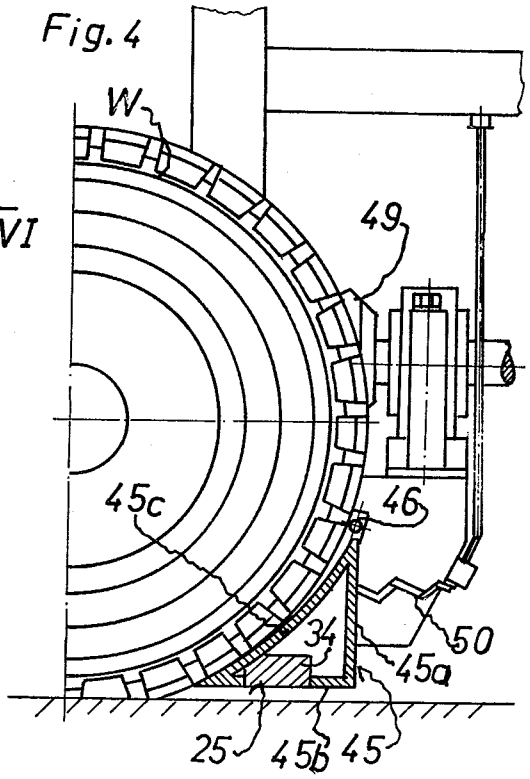
FIG. 4 is a large-scale vertical sectional view through the detail shown in FIG. 3.
Figure 5:
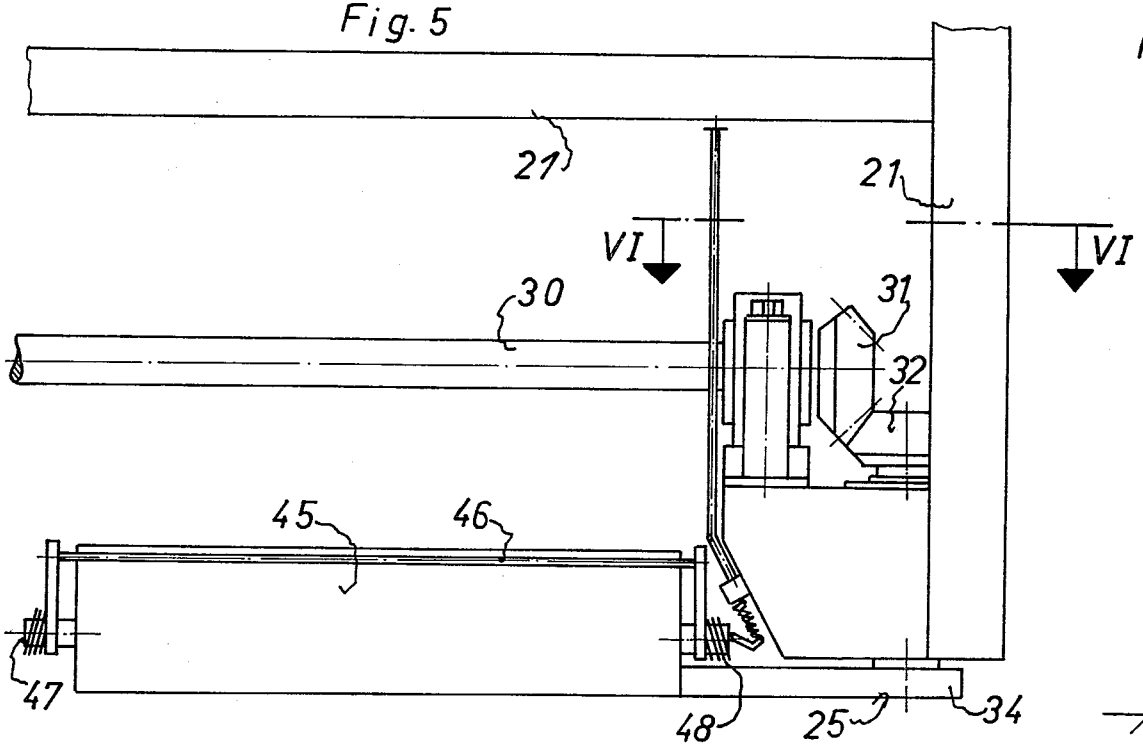
FIG. 5 is a side view of one of the arms shown in the ready position, out of engagement with the motor-vehicle wheel.

As best shown in FIGS. 4–6 each of the arms 25 basically comprises a central bar 34 on which is supported a generally triangular-section hollow arm member 45 having a pair of sides **45*a* and 45*b* extending vertically and horizontally, respectively, and joined by a hypotenuse portion 45*c* which is approximately quarter-cylindrical and is shaped to fit against a wheel W of a motor vehicle or car C received between the sides 21 of the frame 5**.

The arms can be swung from the position shown in FIGS. 5 and 6 parallel to the respective shaft 30 and the cross member 27 into a position 90° offset therefrom and pointing directly toward the opposite arm 25 as shown in FIG. 1. In this transverse position each of the surfaces **45*c*** engages against the corresponding inside face of a motor vehicle wheel W.

Figure 3:
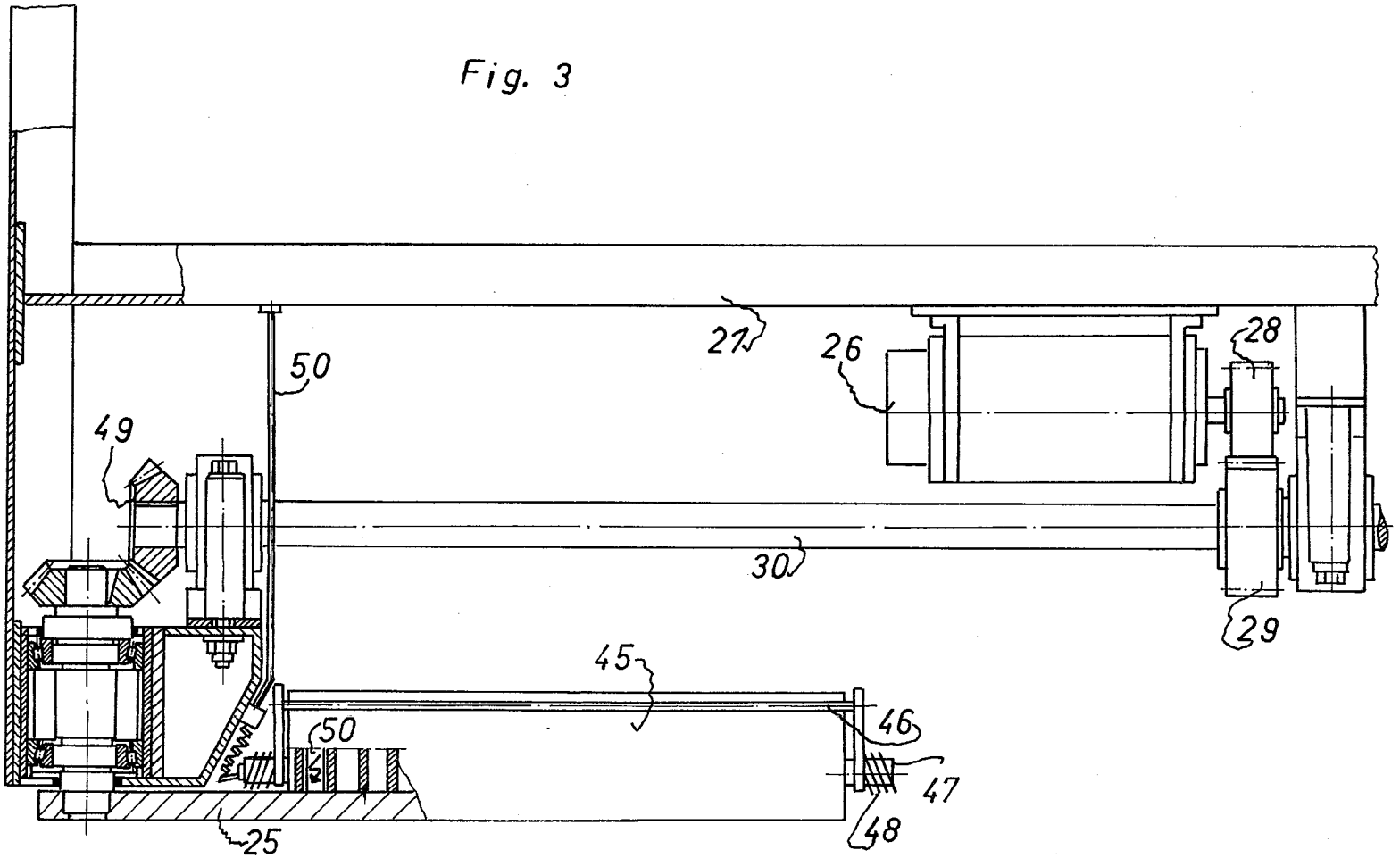
FIG. 3 is a large-scale sectional view of a detail of FIG. 1.

Provided on each of the arms 25 is a switch element 46 constituted as a rod and mounted on arms pivoted on an axle 47 provided on the respective hollow housing 45 and urged via torsion springs 48 at each end into the position illustrated in FIGS. 3, 5, and 6, that is spaced above the surface **45*c*. From this position the rod 46 may be pivoted back as shown in FIG. 4 to a position out from between the wheel W in the surface 45*c*. Each of these rods 46 is linked to a switch 50' inside the housing 45 and connected via an at least partially flexible cable 50 to the motor 26**.

The motor 26 is normally operated once the frame 5 has been placed adjacent a car C to swing the two arms out. During this swinging the pickup arrangement 105 is not fixed on its rail 104 so that the arms 25 will swing out into engagement between the wheels W of the car C. If one of the arms 25 strikes against its wheel first it will therefore shift the entire frame in the opposite direction. Once both of the arms have come to rest against their respective wheels, both of the rods 46 will be deflected and the switches 50' will together shut off the respective motor 26. Thus a self-centering arrangement is provided. Since the arms are linked positively to one another, they remain rigid in this position and the lower frame portion 21 can then be raised to lift the entire car C off the ground. During such lifting the car is supported entirely on its road-engaging wheel so that the possibility of damage to the car is minimized. The motor 26 is either of the self-braking type which cannot be rotated when not electrically energized, or is associated with an automatic brake arrangement that prevents its output gear 28 from being rotated when the motor is not operating.

It will be understood that each of the elements described above, or two or more together, may also find a useful application in other types of structures differing from the types described above.

While the invention has been illustrated and described as embodied in a motor-vehicle lifting apparatus it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of this invention.

What is claimed as new and desired to be protected by Letters Patent is set forth in the appended claims:

1. In a storage installation for motor vehicles each having two front and two rear ground-engaging wheels, vehicle handling apparatus comprising:

a horizontally displaceable support frame dimensioned and shaped to straddle a motor vehicle said frame including an upper portion and a lower portion, means to move said lower portion vertically relative to said upper portion;

two respective front and two respective rear horizontally enlongated arms pivotally mounted on said lower portion about respective upright axes and each having a horizontally elongated surface facing generally upwardly and inclinded to the vertical and to the horizontal and engageable with a respective wheel of a motor vehicle straddled by said frame, said axes being relatively nondisplaceable relative to each other on said frame;

drive means on said lower portion for pivoting said front arms in one direction about their respective axes and said rear arms in the opposite direction about their respective axes and thereby bringing said surface into and out of engagement with and generally under the respective wheels;

a deflectable switch element pivotally mounted on a respective arm and extending horizontally the full length of each surface and displaceable backwardly relative to the respective pivoting direction of the respective arm toward the respective surface only on engagement of same with the respective wheel;

a switch connected to the respective element and actuatable only on engagement of the respective element with a wheel; and means interconnecting said switches with said drive means for arresting said arms and stopping pivoting thereof on engagement of the respective elements with said wheels, whereby each arm is swung in by the drive means and is stopped when the respective switch element engages the respective wheel.

2. The apparatus defined in claim 1 wherein said surface is generally part-cylindrical and generally upwardly concave.

3. The apparatus defined in claim 2 wherein each surface is shaped complementarily to the respective wheel.

4. The apparatus defined in claim 3 wherein each switch element is a rod extending parallel to the respective surface.

5. The apparatus defined in claim 4 wherein each switch element is pivoted on the respective arm about a respective horizontal switch axis.

6. The apparatus defined in claim 5 wherein each arm is provided with a spring biasing the respective element pivotally into a position above and spaced from the respective surface and compressible on displacement of the respective arm toward the respective surface.

7. The apparatus defined in claim 6 wherein each element is displaceable pivotally into a position out from between the respective wheel and the respective surface.

8. The apparatus defined in claim 1 wherein said arms are of generally right-triangular section and said surface is the hypotenuse side of the respective arm, said switches each being provided within the respective arm.

9. The apparatus defined in claim 1, wherein said drive means includes a pair of motors each having a shaft extending between and positively connected to two of said arms.

10. The apparatus defined in claim 9, wherein each drive motor is connected to a respective one of said front arms and a respective one of said rear arms, said front arms being pivotal forwardly away from said rear arms and same being pivotal backwardly away from said front arms.

* * * * *